US009629433B1

(12) United States Patent
Lawrence

(10) Patent No.: US 9,629,433 B1
(45) Date of Patent: Apr. 25, 2017

(54) TRAVEL LUGGAGE WITH A MECHANISM FOR COMPRESSING CONTENTS

(71) Applicant: Larry Lawrence, Acampo, CA (US)

(72) Inventor: Larry Lawrence, Acampo, CA (US)

( * ) Notice: Subject to any disclaimer, the term of this patent is extended or adjusted under 35 U.S.C. 154(b) by 47 days.

(21) Appl. No.: 14/633,424

(22) Filed: Feb. 27, 2015

(51) Int. Cl.
*A45C 13/04* (2006.01)
*A45C 13/02* (2006.01)
*A45C 5/14* (2006.01)

(52) U.S. Cl.
CPC ..... *A45C 13/02* (2013.01); *A45C 5/14* (2013.01); *A45C 13/04* (2013.01)

(58) Field of Classification Search
CPC ..... A45C 13/02; A45C 13/04
USPC ..... 190/13 B, 13 C, 24, 36, 110, 122; 206/282, 817
See application file for complete search history.

(56) References Cited

U.S. PATENT DOCUMENTS

| | | | | |
|---|---|---|---|---|
| 1,540,331 | A * | 6/1925 | Hawley | A47B 61/06 190/13 B |
| 1,913,021 | A * | 6/1933 | Butterick | A45C 13/03 190/36 |
| 4,630,717 | A | 12/1986 | Tong | |
| 4,854,430 | A | 8/1989 | Peterson | |
| 7,328,779 | B2 | 2/2008 | King et al. | |
| 7,673,407 | B2 * | 3/2010 | Cowdrey | G09F 11/21 40/406 |
| 2013/0140120 | A1 * | 6/2013 | Rasmussen | A45C 7/009 190/109 |

* cited by examiner

*Primary Examiner* — Sue A Weaver
(74) *Attorney, Agent, or Firm* — Stevenson IP, LLC

(57) ABSTRACT

A travel luggage is disclosed that is made from a base portion and a lid portion pivotally attached to the base portion. An internal frame disposed within the base portion includes a length of canvas that is attached to a frame, with the canvas also being attached to a mounted support pipe which is in operational communication with a series of winch gears and a crank handle. Once various items have been placed within the travel luggage and more storage space is desired, an individual can rotate the crank handle, which forces the canvas to compress the items already placed in the travel luggage. Additional items, as needed, can then be placed into the travel luggage.

5 Claims, 7 Drawing Sheets

TRAVEL LUGGAGE WITH A MECHANISM FOR COMPRESSING CONTENTS

BACKGROUND OF THE INVENTION

Various types of travel luggage are in use and are known in the prior art. However, existing travel luggage frequently is not quite large enough for the needs of a traveler, but nonetheless, must be accepted for general use based on airline company industry requirements that are standard across the industry.

FIELD OF THE INVENTION

Various types of travel luggage are in use and are known in the prior art. Existing travel luggage is generally considered as one of three items—a personal item, a carry-on, and a checked bag. Frequently, people use a "carry on," as it allows a traveler to have the security of a checked bag, but also provides easy access when the plane is in flight. However, carry-on bags are fairly small in volume, which requires travelers to pack as much as possible into the carry-on. The present invention includes a packing mechanism incorporated into carry-on luggage that allows one to tightly pack items efficiently and quickly, and the mechanism can also be used for checked bags as well.

SUMMARY OF THE INVENTION

The travel luggage is made from a base portion and a lid portion pivotally attached to the base portion. An internal frame disposed within the base portion includes a length of canvas that is attached to a frame, with the canvas also being attached to a mounted support pipe which is in operational communication with a series of winch gears and a crank handle. Once various items have been placed within the travel luggage and more storage space is desired, an individual can rotate the crank handle, which forces the canvas to compress the items already placed in the travel luggage. Additional items, as needed, can then be placed into the travel luggage.

Thus has been broadly outlined the more important features of the present travel luggage so that the detailed description thereof that follows may be better understood and in order that the present contribution to the art may be better appreciated.

DETAILED DESCRIPTION OF THE DRAWINGS

Figure 1:
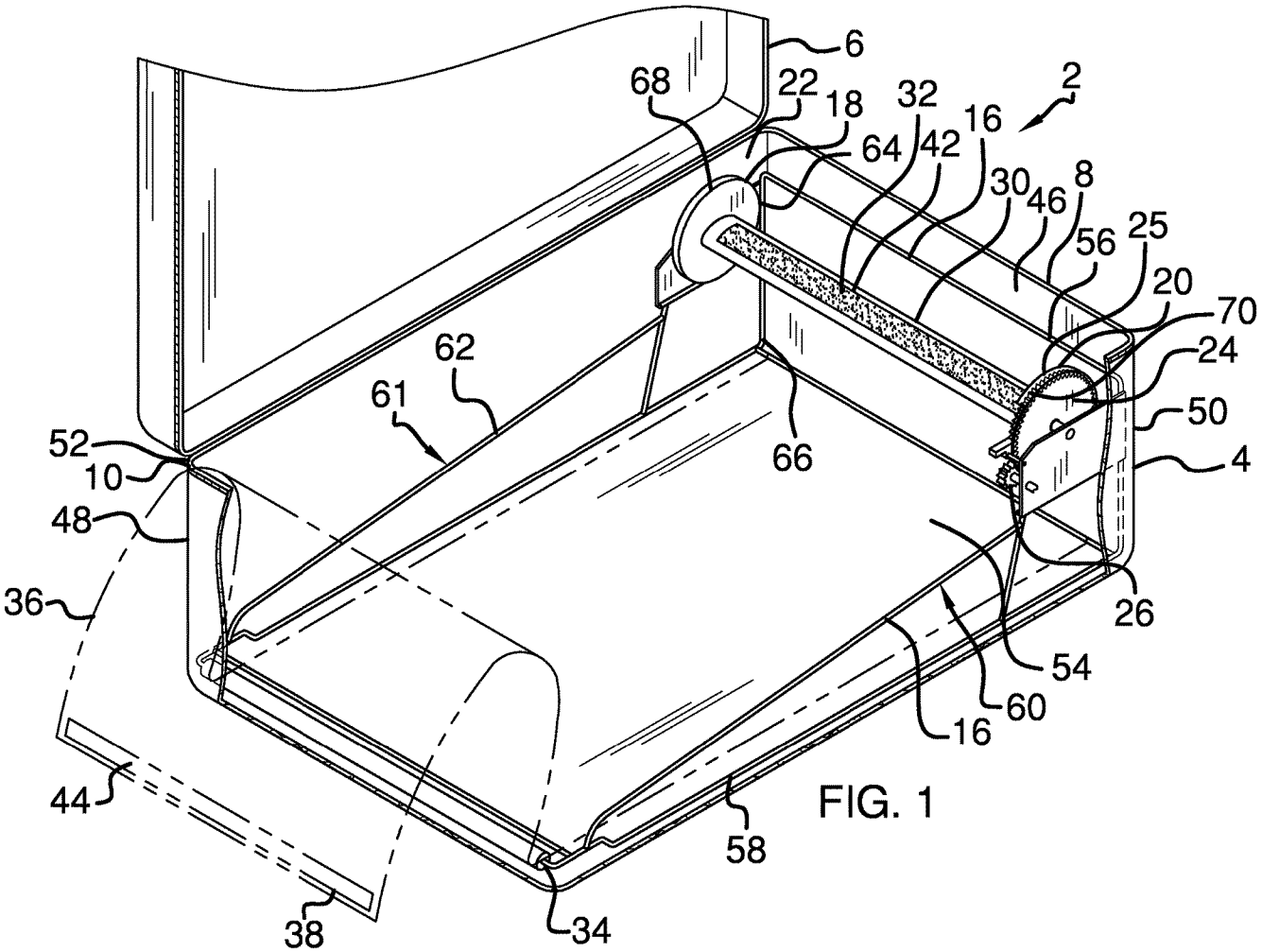
FIG. 1 is an isometric view with a partial cutaway view.
Figure 2:
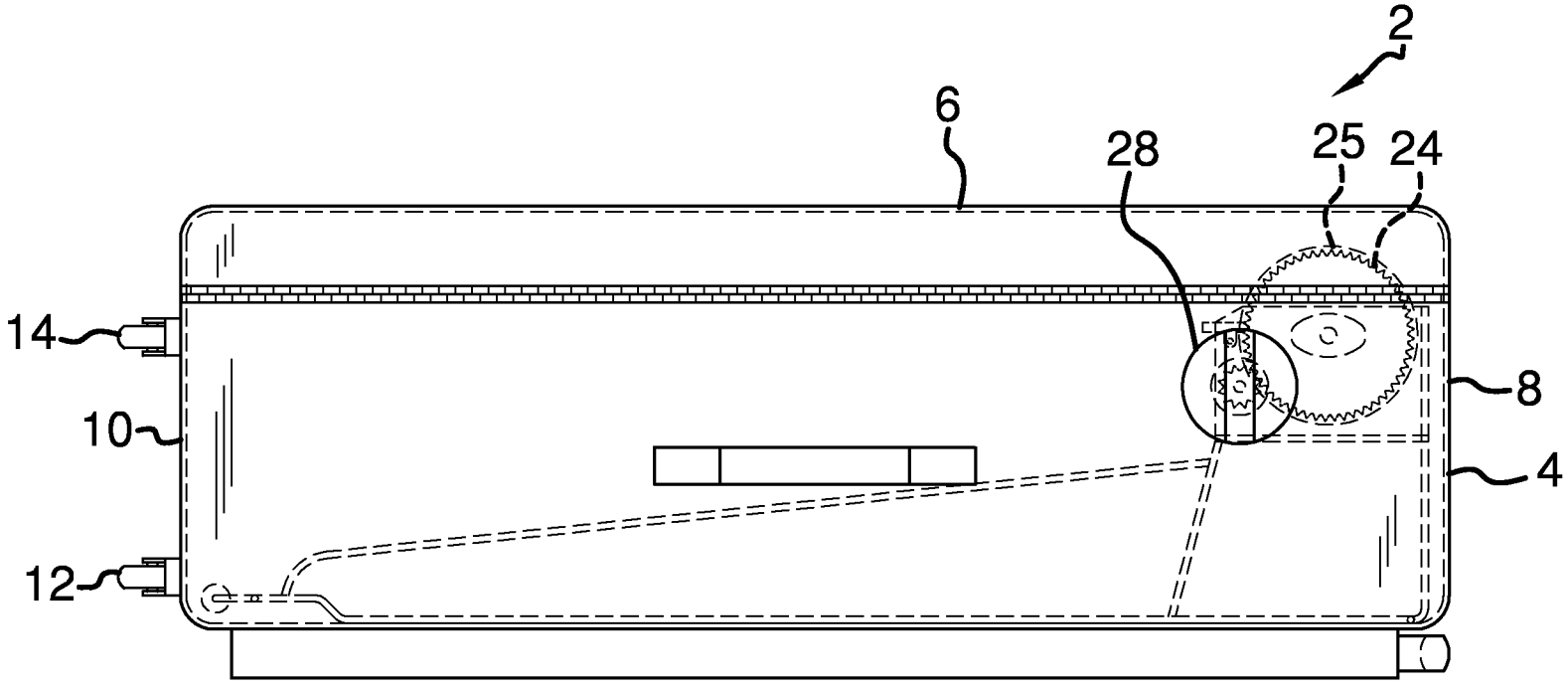
FIG. 2 is a front view.
Figure 3:
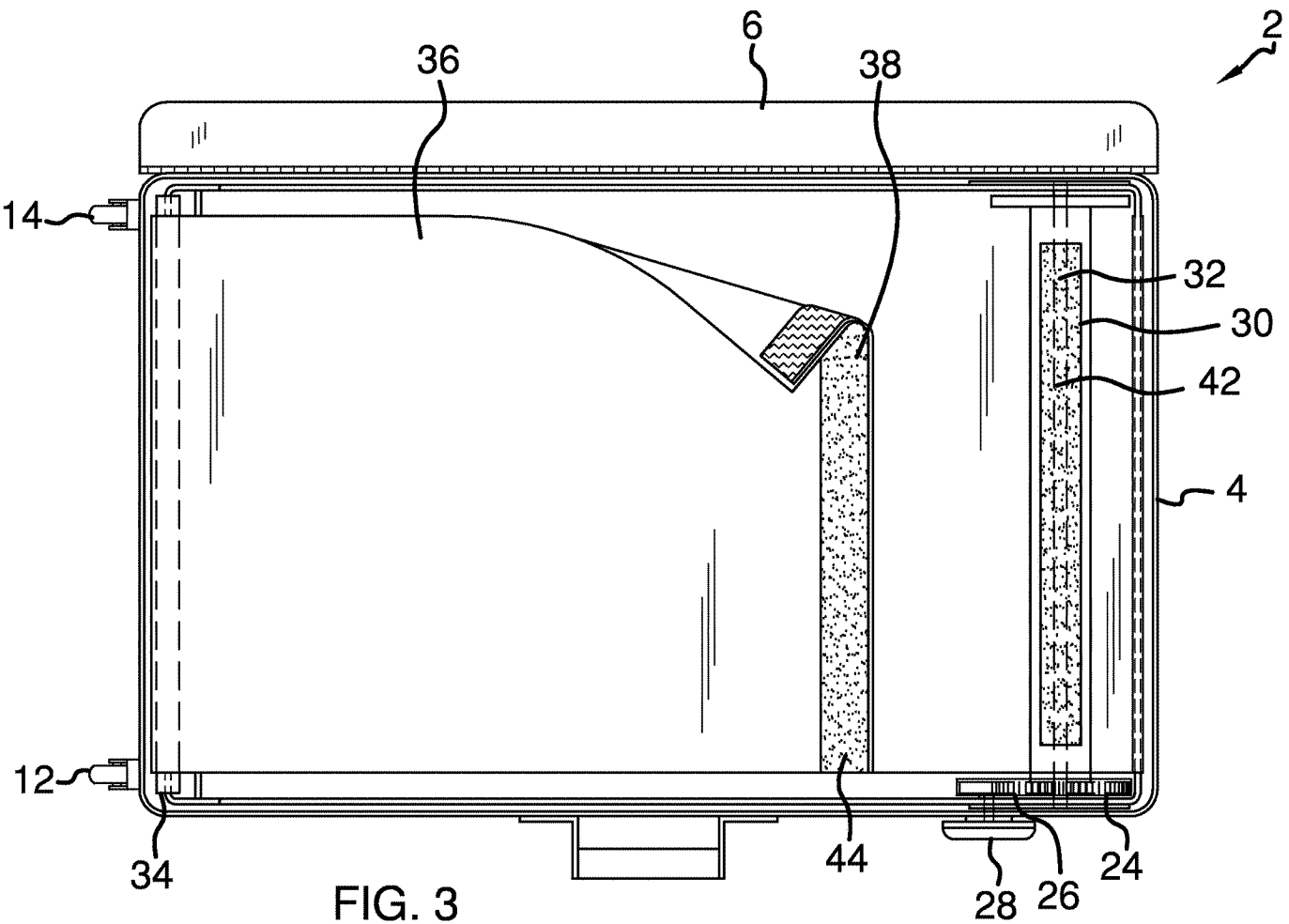
FIG. 3 is a top view.
Figure 4:
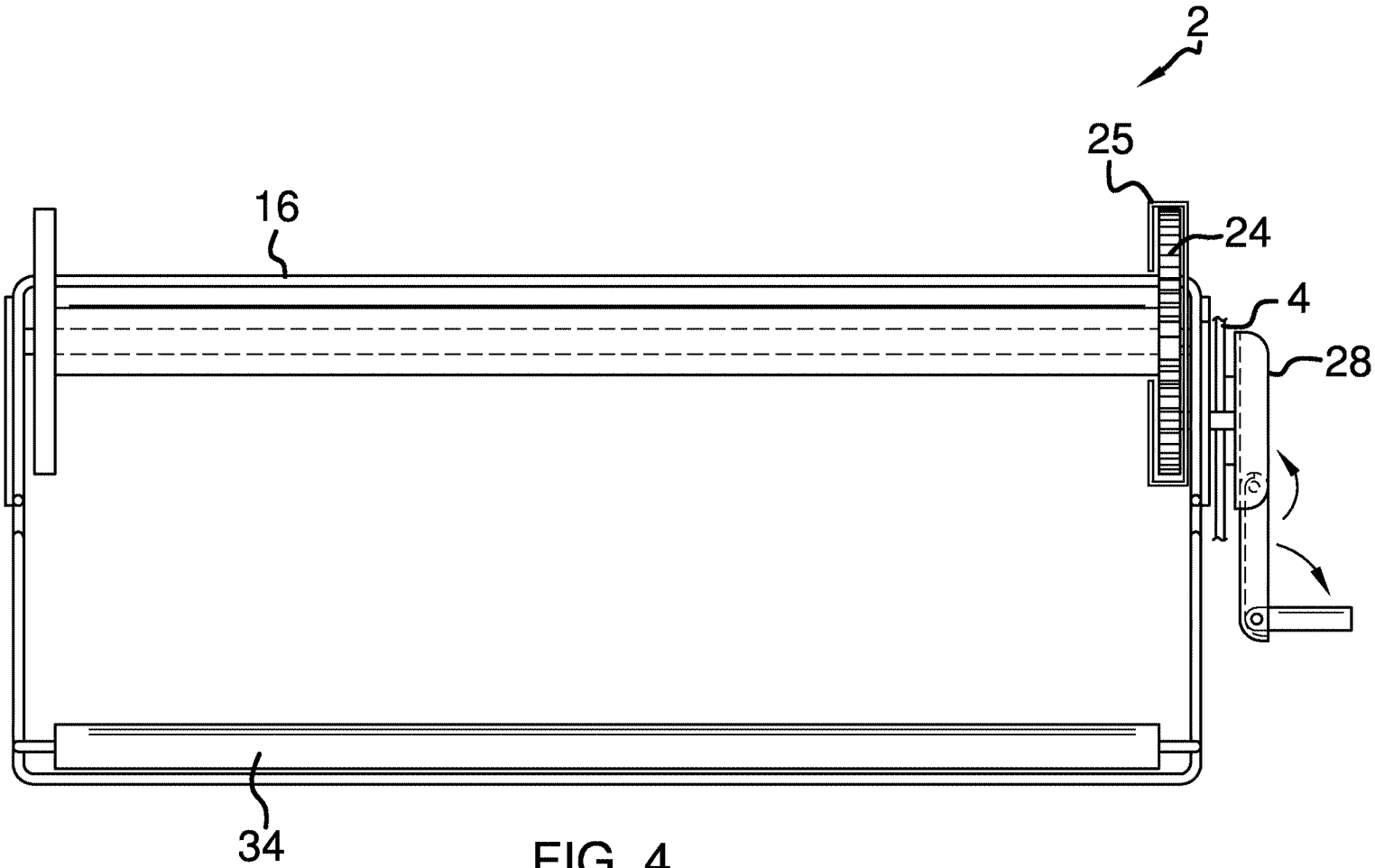
FIG. 4 is an end view.

With reference now to the drawings, and in particular FIGS. 1 through 7 thereof, an example of the travel luggage employing the principles and concepts of the present invention and generally designated by the reference number 2 will be described.

Referring to FIGS. 1 through 7, a preferred embodiment of the present invention is disclosed. The travel luggage 2 disclosed herein includes a base portion 4 and a top portion 6 pivotally attached to the base portion 4. The base portion 4 includes a top end 8, a bottom end 10, a right end 46, a left end 48, a front end 50, a rear end 52, and a cavity 54 therein, and also includes with a pair of travel wheels 12 and 14 being externally mounted to the base portion proximal the bottom end 10.

A frame 16 is disposed within the cavity 54 of the base portion 4 and includes a rectangular right section 56 disposed on right end 46 of the base portion, a rectangular bottom section 58 disposed on the bottom end 10, and a substantially L-shaped section 60, 61 disposed on each of the front end 50 and the rear end 52. Each L-shaped section 60, 61 has a first section 62, a second section 64 substantially perpendicular to the first section 62 and substantially parallel to the respective front end 50 and rear end 52, and a connection point 66 at a juncture of the first section 62 and second section 64.

A support bracket 68, 70 is attached to each of the front end 50 and the rear end 52 in a position between the connection point 66 and a most proximal portion of the right section. An upper mount 18, 20 is disposed on each of the support brackets 68, 70. A support pipe 30 is continuously disposed between and connects the upper mounts 18, 20. Each of the upper mounts 18, 20 are mounted to the inner surface 22 of the base portion 4 proximal the top end 8 of the base portion 4.

Upper right mount 20 is in operational communication with a primary winch gear 24, which is also mounted on the inner surface 22 of the base portion 4 and is protected by shield 25. Primary winch gear 24 is connected to a secondary winch gear 26, which has a smaller diameter than the primary winch gear 24 and is also mounted on the inner surface 22 of the base portion 4. A crank handle 28 is in operational communication with the secondary winch gear 26 and is disposed outside the base portion 4 of the travel luggage 2.

A support pipe 30 is attached to both of the mounts 18, 20, and includes a first patch 32 of a hook and loop fastening system attached to the pipe 30. The first patch 32 runs lengthwise on the support pipe 30. An individual can rotate the support pipe by turning the crank handle 28, which proceeds to turn, in succession, the secondary winch gear 26 and the primary winch gear 24, which then rotates the mounts 18, 20.

The frame 16 also includes a frame roller 34 that is disposed proximal the bottom end 10 of the base portion 4. Canvas 36 is attached to the frame 16 proximal the top end 8 of the base portion 4 and includes a second patch 38 of a hook and loop fastening system. The first patch 32 and the second patch 38 are complementary to one another and will removably attach to one another while placed in contact with each other.

Figure 5:
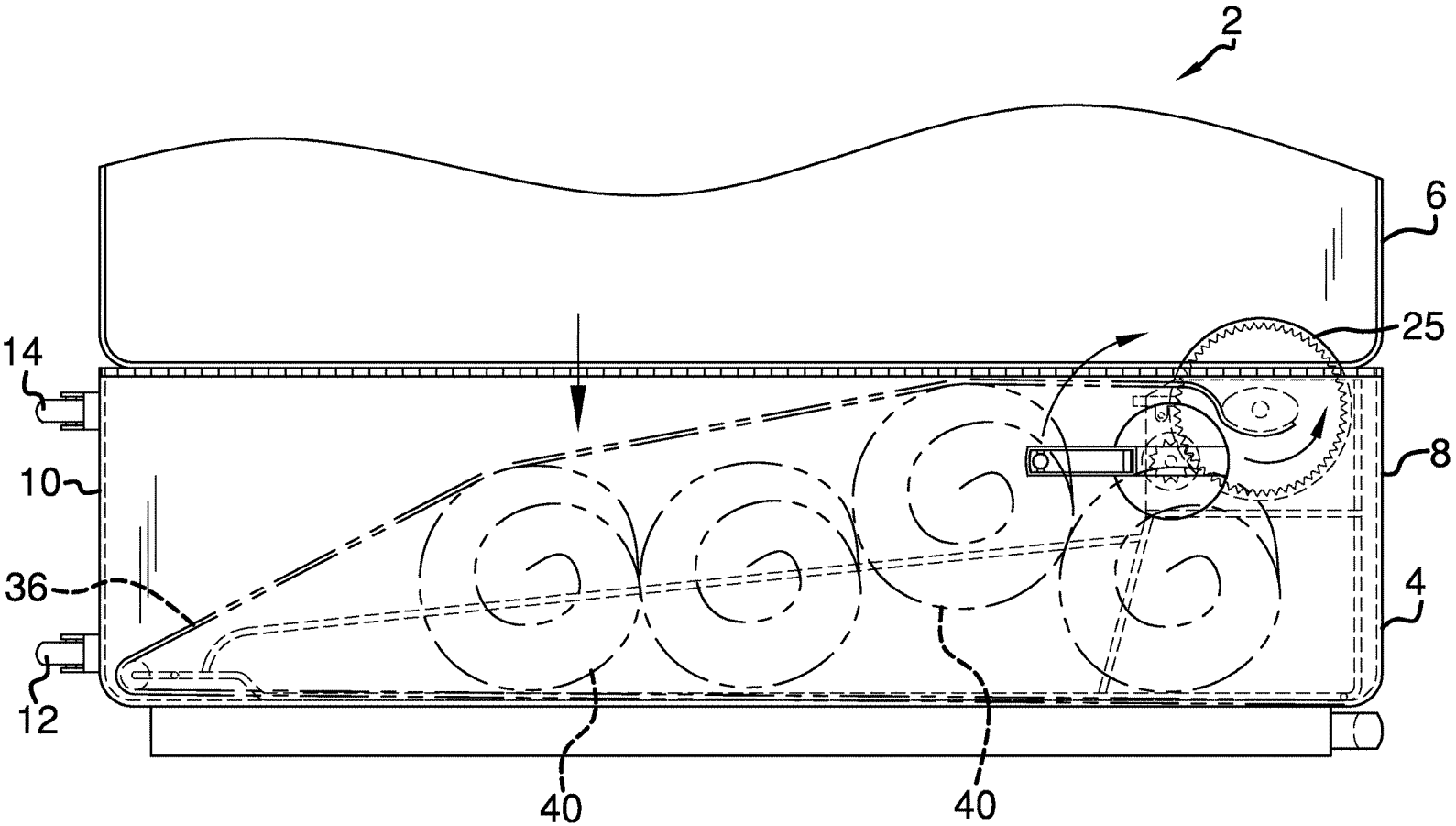
FIG. 5 is an in-use side view showing a canvas being disposed underneath an end roller in operational communication with the frame.
Figure 6:
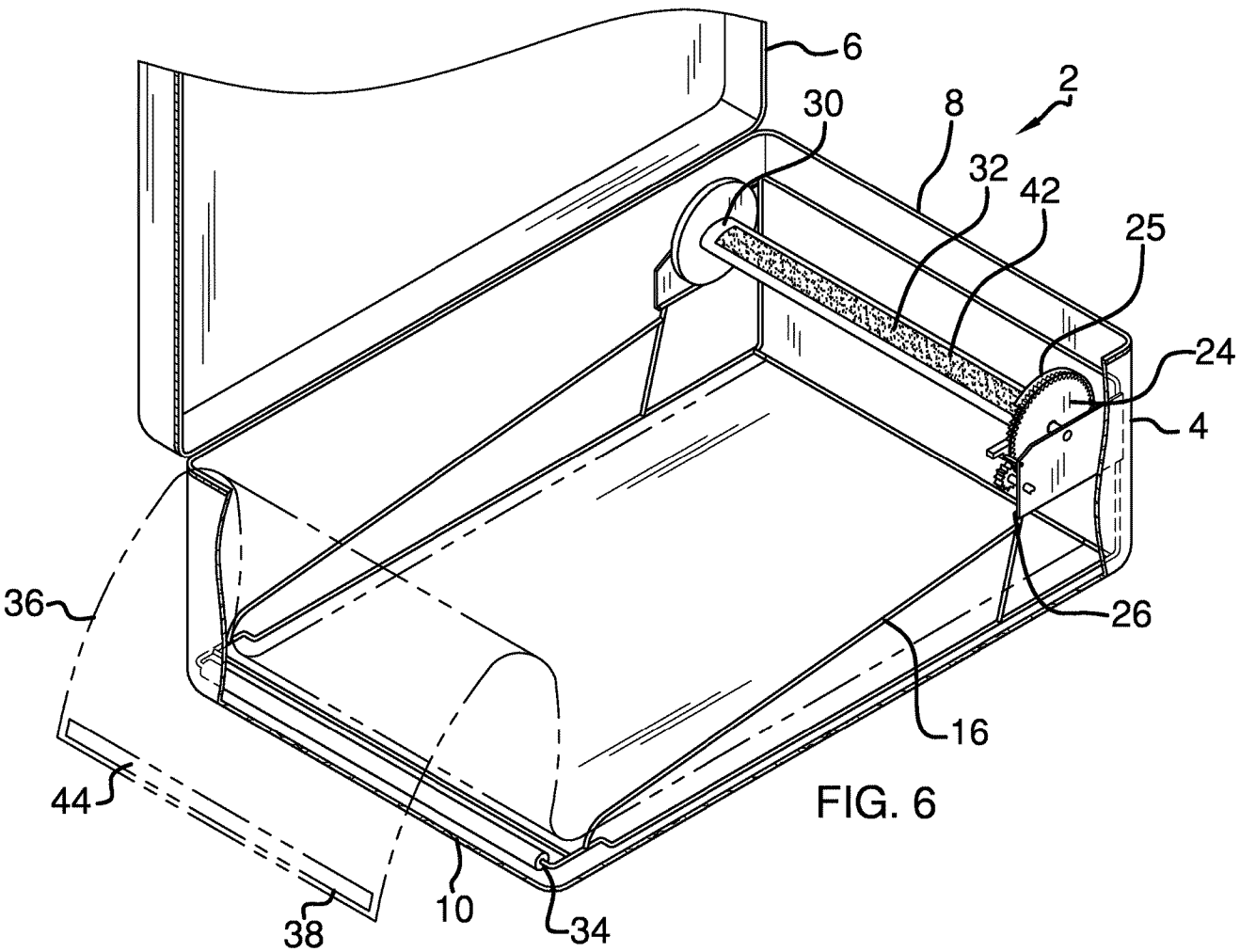
FIG. 6 is an isometric view with the canvas disposed overlapping a frame roller in operational communication with the frame.

Canvas 36 can be utilized with the travel luggage 2 in two different ways to help an individual compress existing items 40 within the travel luggage 2. In FIG. 5, the canvas 36 travels underneath the frame 16, around the frame roller 34, over existing items 40 within the travel luggage 2, and then the second patch 38 is placed into contact with the first patch 32. The first patch 32 includes a first plurality of attachment items 42, while the second patch 38 includes a second plurality of attachment items 44. One of the pluralities of attachment items is a plurality of loops, while the other plurality of attachment items is a plurality of hooks. Once the configuration in FIG. 5 is achieved, an individual can grab the crank handle 28, which then causes the canvas to provide a strong downward force on the items 40. Once the desired compression factor is reached, then the individual can placed additional items within the travel luggage 2 before removably attaching the top portion 6 to the base portion 4.

Figure 7:
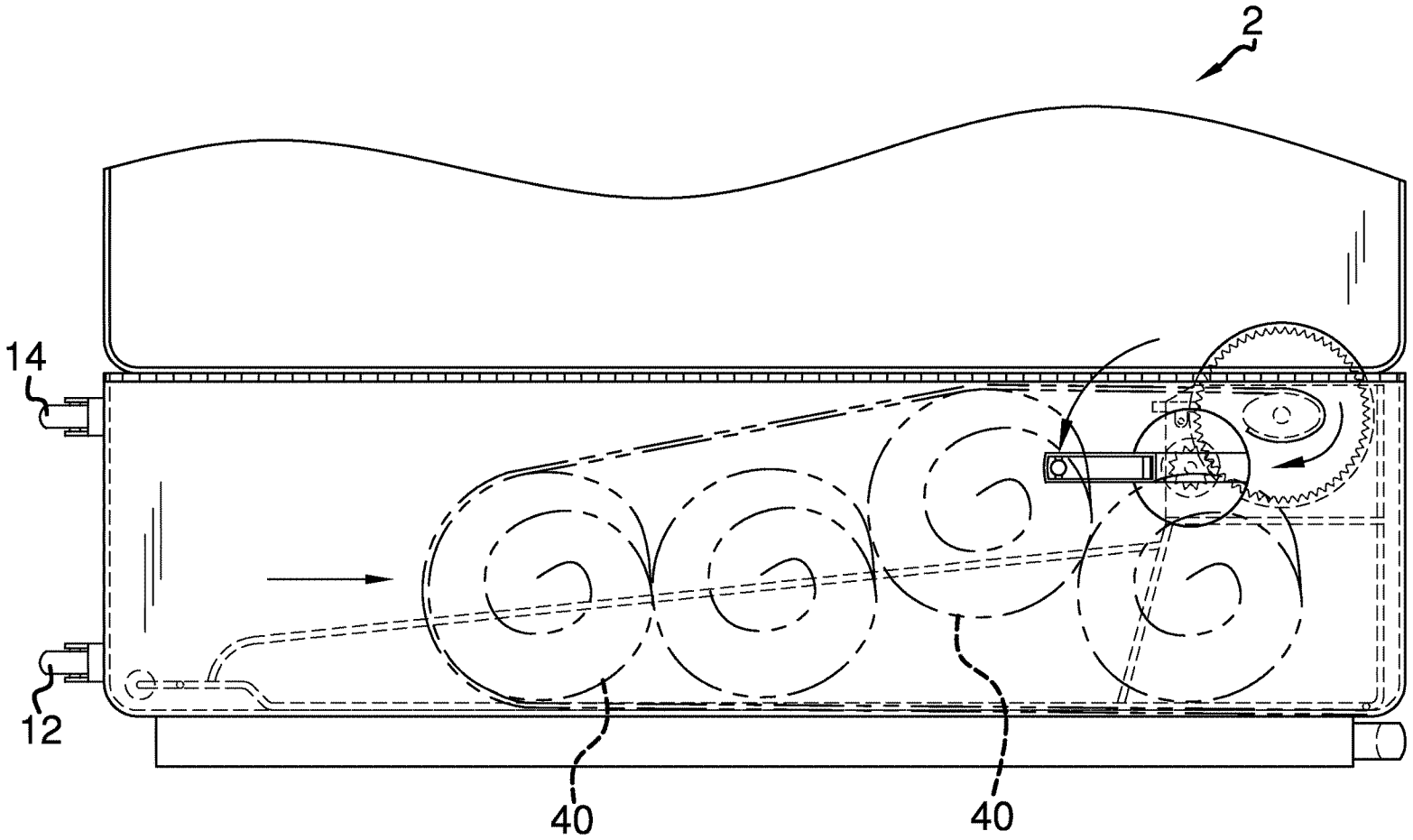
FIG. 7 is an in-use side view showing the canvas being disposed underneath an end roller attached to the frame.

The travel luggage 2 can be used as shown in FIG. 7 with the canvas 36 traveling underneath the frame 16 but not wrapping around the frame roller 34. However, the canvas 36 still wraps around existing items 40 within the travel luggage 2 once the second patch 38 is placed into contact with the first patch 32. Once the configuration in FIG. 7 is achieved, an individual can grab the crank handle 28, which then causes the canvas to provide a strong inward force on the items 40. Once the desired compression factor is reached, then the individual can placed additional items within the travel luggage 2 before removably attaching the top portion 6 to the base portion 4.

Using the travel luggage 2 as shown in FIG. 5 has the canvas 36 providing a stronger downward force, while using the travel luggage 2 as shown in FIG. 7 has the canvas 36 providing a stronger inward force. Either way, the travel luggage 2 assists an individual by providing a strong compression force on items 40 in an easier manner than having an individual provide his own inward force, either by weight or by force.

The invention claimed is:

1. A travel luggage comprising:

a base portion having a top end, a bottom end, and an inner surface, wherein the base portion further comprises a right end, a left end, a front end, a rear end, and a cavity therein;

a pair of travel wheels comprising a first travel wheel and a second wheel, wherein each travel wheel is disposed on the base portion proximal the bottom end of the base portion;

a top portion pivotally attached to the base portion;

a frame disposed within the base portion, the frame further comprising a rectangular right section disposed on the right end of the base portion, a rectangular bottom section disposed on the bottom end of the base portion, and a substantially L-shaped section disposed on each of the front end of the base portion and the rear end of the base portion, wherein each L-shaped section further comprises a first section, a second section substantially perpendicular to the first section and substantially parallel to the respective front end of the base portion and the rear end of the base portion, and a connection point at a juncture of the first section and second section;

a pair of support brackets, wherein a support bracket is attached to each of the front end and the rear end in a position between the connection point and a most proximal portion of the right section;

a pair of upper mounts, wherein an upper mount is disposed on each of the support brackets;

a frame roller disposed proximal the bottom end of the base portion;

a plurality of winch gears, wherein each of the winch gears of the plurality of winch gears are mounted on the inner surface of the base portion, wherein one of the plurality of winch gears are in operational communication with the upper right mount;

a crank handle, wherein the crank handle is in operational communication with one of the winch gears of the plurality of winch gears, the crank handle being disposed on the base portion of the item of travel luggage proximal the winch gears;

a support pipe, wherein the support pipe is in operational communication with each upper mount of the plurality of upper mounts;

a first patch of a hook and loop fastening system, wherein the first patch is attached to the support pipe, a first plurality of attachment items attached to the first patch;

a canvas attached to the frame proximal the top end of the base portion;

a second patch of a hook and loop fastening system, wherein the second patch is attached to the canvas;

a second plurality of attachment items attached to the second patch;

wherein the second patch of the hook and loop fastening system on the canvas can be removably attached to the first patch on the support pipe;

further wherein the crank handle is configured to be turned, thereby causing the canvas to compress any items that were placed within the base portion on top of the canvas.

2. The travel luggage according to claim 1 wherein the plurality of winch gears further comprises:

a primary winch gear, wherein the primary winch gear is in operational communication with the upper right mount, further wherein the primary winch gear is mounted on the inner surface of the base portion;

a secondary winch gear, wherein the secondary winch gear is connected to the primary winch gear, further wherein the secondary winch gear is mounted on the inner surface of the base portion;

wherein the crank handle is in operational communication with the secondary winch gear.

3. The travel luggage according to claim 2 wherein the secondary winch gear has a smaller diameter than the diameter of the primary winch gear.

4. The travel luggage according to claim 3 wherein the first patch of the hook and loop fastening system runs lengthwise on the support pipe.

5. The travel luggage according to claim 4 wherein the travel luggage further comprises:

a shield, wherein the shield is disposed within the base portion of the travel luggage;

wherein the shield envelops the primary winch gear.

* * * * *